US011565534B2

(12) United States Patent
Ojima et al.

(10) Patent No.: US 11,565,534 B2
(45) Date of Patent: Jan. 31, 2023

(54) METHOD FOR MANUFACTURING CANS FOR BEVERAGE, AND BEVERAGE CAN MANUFACTURING METHOD

(71) Applicant: ALTEMIRA Co., Ltd., Tokyo (JP)

(72) Inventors: Shinichi Ojima, Tokyo (JP); Kazunori Ikeda, Tokyo (JP); Asumi Suwa, Tokyo (JP); Kazuhisa Masuda, Tokyo (JP)

(73) Assignee: ALTEMIRA Co., Ltd., Tokyo (JP)

( * ) Notice: Subject to any disclaimer, the term of this patent is extended or adjusted under 35 U.S.C. 154(b) by 253 days.

(21) Appl. No.: 16/624,576

(22) PCT Filed: Jun. 21, 2018

(86) PCT No.: PCT/JP2018/023700
§ 371 (c)(1),
(2) Date: Dec. 19, 2019

(87) PCT Pub. No.: WO2019/026461
PCT Pub. Date: Feb. 7, 2019

(65) Prior Publication Data

US 2020/0122495 A1 Apr. 23, 2020

(30) Foreign Application Priority Data

Jul. 31, 2017 (JP) ..... JP2017-147855

(51) Int. Cl.
*B41J 3/407* (2006.01)
*B21D 51/26* (2006.01)
(Continued)

(52) U.S. Cl.
CPC ..... *B41J 3/4073* (2013.01); *B21D 51/26* (2013.01); *B41J 2/01* (2013.01); *B41J 3/40733* (2020.08); *B41M 5/0088* (2013.01)

(58) Field of Classification Search
CPC ..... B41J 3/4073; B41J 3/40733; B41J 2/01; B21D 51/26; B41M 5/0088
See application file for complete search history.

(56) References Cited

U.S. PATENT DOCUMENTS 5,202,013 A * 4/1993 Chamberlain ..... C25D 11/18 205/120
6,463,776 B1 10/2002 Enoki et al.
(Continued)

FOREIGN PATENT DOCUMENTS

CN 101537904 A 9/2009
CN 103492272 A 1/2014
(Continued)

OTHER PUBLICATIONS

Communication dated Jan. 14, 2021, from the European Patent Office in application No. 18840931.2.
(Continued)

*Primary Examiner* — David H Banh
(74) *Attorney, Agent, or Firm* — Sughrue Mion, PLLC

(57) ABSTRACT

A can body that has been subjected to outer surface painting (OV), inner surface painting (INS), and a neck process (SDN) but that has not been subjected to image formation is manufactured in a canning factory. The can body that has not been subjected to image formation is shipped to a beverage can manufacturing factory. At the beverage can manufacturing factory, an image formation process using a printer (PR) is performed. Specifically, ink is ejected from an inkjet head toward the can body, to thereby form an image on the outer circumferential surface of the can body. Thereafter, the can body is filled with beverage in a filler (FL), and then a can lid is attached to the can body in a seamer (SM).

11 Claims, 12 Drawing Sheets

(51) Int. Cl.
*B41J 2/01* (2006.01)
*B41M 5/00* (2006.01)

(56) References Cited

U.S. PATENT DOCUMENTS

| | | | | |
|---|---|---|---|---|
| 7,354,234 | B2 * | 4/2008 | Fujishige | B21D 51/26 413/2 |
| 2004/0011113 | A1 | 1/2004 | Jakob | |
| 2006/0250464 | A1 | 11/2006 | Sheinman et al. | |
| 2006/0277957 | A1 * | 12/2006 | Fujishige | B21D 51/26 72/46 |
| 2010/0257819 | A1 * | 10/2010 | Schach | B41J 3/40733 53/411 |
| 2012/0274695 | A1 | 11/2012 | LaCaze et al. | |
| 2013/0176358 | A1 | 7/2013 | Yamada et al. | |
| 2014/0028771 | A1 | 1/2014 | Yamada et al. | |
| 2016/0221708 | A1 * | 8/2016 | Ojima | B41J 3/40733 |
| 2016/0303879 | A1 | 10/2016 | Yamada et al. | |
| 2017/0144453 | A1 * | 5/2017 | Till | B41J 3/407 |
| 2017/0157964 | A1 | 6/2017 | Izume | |

FOREIGN PATENT DOCUMENTS

| | | | |
|---|---|---|---|
| CN | 106276119 | A | 1/2017 |
| EP | 1 136 154 | A1 | 9/2001 |
| EP | 3 175 987 | A1 | 6/2017 |
| JP | 62-27170 | A | 2/1987 |
| JP | 2001-315495 | A | 11/2001 |
| JP | 2002-12986 | A | 1/2002 |
| JP | 2003-034333 | A | 2/2003 |
| JP | 2003-205924 | A | 7/2003 |
| JP | 2004-42916 | A | 2/2004 |
| JP | 2004-82153 | A | 3/2004 |
| JP | 2004-509766 | A | 4/2004 |
| JP | 3 603975 | B2 | 12/2004 |
| JP | 2007-70049 | A | 3/2007 |
| JP | 2008-183613 | A | 8/2008 |
| JP | 2008-248289 | A | 10/2008 |
| JP | 2009-26009 | A | 2/2009 |
| JP | 2012-86870 | A | 5/2012 |
| JP | 2012-232771 | A | 11/2012 |
| JP | 2014-8657 | A | 1/2014 |
| JP | 2014-58142 | A | 4/2014 |
| JP | 2014-512990 | A | 5/2014 |
| JP | 2015-117030 | A | 6/2015 |
| JP | 2016-16419 | A | 2/2016 |
| WO | 2005/025873 | A2 | 3/2005 |

OTHER PUBLICATIONS

International Search Report for PCT/JP2018/023700 dated Jul. 24, 2018 [PCT/ISA/210].
Notice of Reasons for Revocation dated Sep. 20, 2022 in Japanese Patent No. 7013161, which issued from counterpart Japanese Patent Application No. 2017-147855.

* cited by examiner

METHOD FOR MANUFACTURING CANS FOR BEVERAGE, AND BEVERAGE CAN MANUFACTURING METHOD

CROSS REFERENCE TO RELATED APPLICATIONS

This application is a National Stage of International Application No. PCT/JP2018/023700, filed on Jun. 21, 2018, which claims priority from Japanese Patent Application No. 2017-147855, filed on Jul. 31, 2017.

TECHNICAL FIELD

The present invention relates to a method for manufacturing cans for beverage and a beverage can manufacturing method.

BACKGROUND ART

Patent Document 1 discloses a process of printing plural brands on can bodies by use of plural printers, and thereafter, sorting the can bodies by each brand.

In Patent Document 2, there is disclosed a printing device, in which inkjet printing is performed in at least one inkjet printing station, and plural inkjet heads are arranged in the inkjet printing station.

CITATION LIST

Patent Literature

Patent Document 1: Japanese Patent Application Laid-Open Publication No. 2008-183613

Patent Document 2: Japanese Patent Application Laid-Open Publication No. 2012-232771

SUMMARY OF INVENTION

Technical Problem

In a storage process of can bodies used as the cans for beverage, can bodies are piled up in the axial direction of the can bodies to be stored in many cases, and in these cases, it is preferable to decrease a diameter of an opening of a can body to secure the strength of the can body. Moreover, in conventional methods for manufacturing can bodies, it was a common practice that the diameter decreasing process was performed after image formation was performed onto the outer surfaces of the can bodies.

In this case, in the storage process of can bodies, the can bodies having images formed thereon are stored, but in the case where the can bodies with images formed thereon are stored like this, the stored can bodies go to waste when the design is changed, or products are discontinued.

An object of the present invention is to reduce can bodies vainly produced.

Solution to Problem

A method for manufacturing a can for beverage, to which the present invention is applied, includes: a diameter decreasing process decreasing a diameter of an opening portion of a cylindrical can body; and an image formation process forming an image onto an outer surface of the can body having been subjected to diameter decreasing by the diameter decreasing process.

Here, the method further includes a paint application process applying a paint on at least one of an outer surface and an inner surface of a can body before being subjected to diameter decreasing by the diameter decreasing process.

Moreover, in the image formation process, image formation is performed on the can body by use of an image formation method without contacting a can body, the can body having been subjected to the diameter decreasing.

Moreover, in the image formation process, image formation is performed on the can body by use of an inkjet method, the can body having been subjected to the diameter decreasing.

Moreover, in the image formation process, the can body is supported by a support member inserted into the can body having been subjected to the diameter decreasing to support the can body from inside thereof, the support member including a portion approaching an inner circumferential surface of the can body to contact the inner circumferential surface.

Moreover, in the image formation process, the can body having been subjected to the diameter decreasing is supported by a support member supporting the can body from inside thereof, the support member having a function of sucking a bottom portion of the can body positioned at an opposite side of the opening portion.

From another standpoint, a method for manufacturing a can for beverage, to which the present invention is applied, includes: a molding process molding a cylindrical can body; and a diameter decreasing process decreasing a diameter of an opening portion of the can body molded by the molding process, the can body not being subjected to image formation on an outer surface thereof.

Here, the method further includes a paint application process applying a paint on at least one of an outer surface and an inner surface of a can body before being subjected to diameter decreasing by the diameter decreasing process.

Moreover, in the paint application process, a colored paint is applied to the outer surface of the can body.

Moreover, in the case where the present invention is grasped as a method for manufacturing a beverage can, the method for manufacturing a beverage can, to which the present invention is applied, includes: an image formation process forming an image on an outer surface of a cylindrical can body having been subjected to a diameter decreasing process of an opening portion; and a beverage packaging process filling the can body with beverage, the can body having been subjected to the diameter decreasing process.

Here, in the image formation process, the image is formed on a can barrel portion of the outer surface of the can body having been subjected to the diameter decreasing process, the can barrel portion being a portion of the can body excluding a diameter decreased portion.

Moreover, in the image formation process, image formation is performed on the outer surface of the can body by use of an inkjet method, the can body having been subjected to the diameter decreasing process.

Advantageous Effects of Invention

According to the present invention, it is possible to reduce can bodies vainly produced.

DESCRIPTION OF EMBODIMENTS

Hereinafter, exemplary embodiments according to the present invention will be described in detail with reference to attached drawings.

Figure 1:
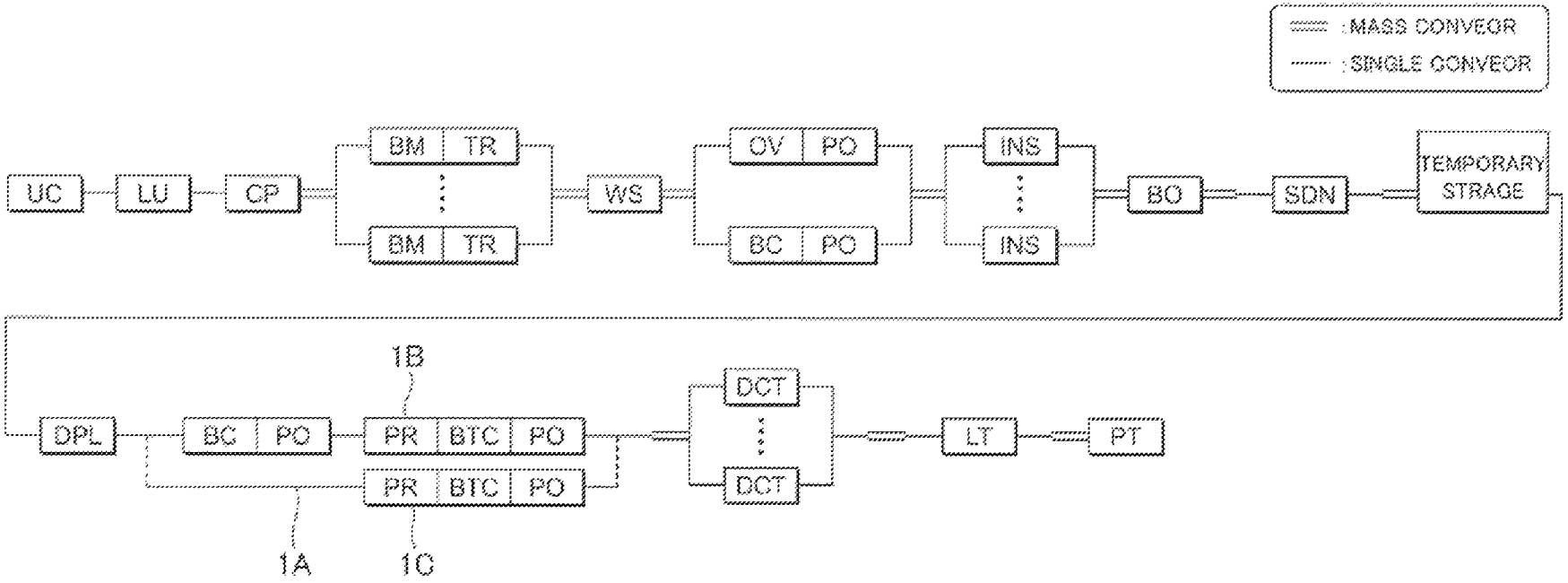
FIG. 1 is a diagram showing a manufacturing process of a can for beverage related to the exemplary embodiment.

FIG. 1 is a diagram showing a manufacturing process of a can for beverage related to the exemplary embodiment.

The manufacturing process shown in FIG. 1 is a manufacturing process of a so-called two-piece can. Specifically, the manufacturing process shown in FIG. 1 molds aluminum or an aluminum alloy by drawing and ironing (DI) molding, and thereafter, an opening end is trimmed to make the heights of cans constant. Next, after the lubricating oil is cleaned, inner surface painting (painting process) and the like are performed. The diagram further shows a process for manufacturing a can for beverage made of metal and having a bottomed cylinder shape, in which decreasing of the diameter of the opening portion and molding of a flange in a neck portion (diameter decreasing process) is performed by a necker Hanger, and thereafter, outer surface printing (image formation process) of a can body by a printer or the like is performed.

Note that symbols (symbols alphabetically expressed) in each figures of FIG. 1 and figures subsequent thereto indicate process names of respective processes constituting the manufacturing process of the two-piece can. In each process, devices corresponding to the process are provided and functions provided to each process are achieved by the devices.

Here, a beverage to be packaged into the can body (the can for beverage) is not particularly limited, and the can body is filled with, for example, an alcoholic beverage, such as beer or Chuhai, or a soft drink (a non-alcoholic beverage) (beverage packaging process). Note that, after packaging, a lid member is attached to the can body, and thereby a beverage can filled with a beverage is completed.

Incidentally, in the following description, a can body before being filled with beverage is referred to as a can for beverage, and a can body after being filled with beverage is referred to as a beverage can in some cases.

As shown in FIG. 1, the manufacturing process of the exemplary embodiment is provided with, from an upstream side in the can body conveyance direction: an uncoiler (UC); a lubricator (LU); a cupping press (CP); a body maker (BM); a trimmer (TR); and a washer (WS) in this order.

In the uncoiler (UC), an aluminum thin plate wound around a coil is unwound. In the lubricator (LU), the aluminum thin plate is coated with lubricating oil. In the cupping press (CP), a circular-shaped blank is punched and is further subjected to drawing, to thereby mold a cup-shaped material.

In the body maker (BM) as an example of a molding process, the cup-shaped material is subjected to the drawing and ironing to make a peripheral wall have a predetermined thickness. Further, a bottom portion thereof is molded to have a dome shape. Consequently, a cylindrical can body having an opening portion at one end and a bottom portion at the other end is molded (DI molding).

Thereafter, in the trimmer (TR), an edge part at the upper portion of the peripheral wall of the can body is trimmed. In the washer (WS), the can body is washed to remove the lubricating oil or other adhered materials, and a chemical conversion coating treatment is performed as needed.

On the downstream side of the washer (WS), an over varnish (OV) as an example of a paint application process is provided. In the over varnish (OV), the outer circumferential surface of the can body is coated with a transparent and colorless outer surface paint.

Further, on the downstream side of the over varnish (OV), a pin oven (PO) is provided. In the pin oven (PO), the can body is heated to bake the outer surface paint onto the can body.

The can body that has passed through the washer (WS) has a large coefficient of friction of the outer surface, and, if the situation continues, conveyance defects of the can bodies are likely to occur. In addition, in this case, the surface of the can body is likely to be damaged.

Provision of the over varnish (OV) causes the can body to be conveyed more smoothly and makes the can body less likely to be damaged.

On the downstream side of the washer (WS), other than the over varnish (OV), a base coater (BC) as another example of the paint application process is provided. In the base coater (BC), a colored paint is applied to the outer circumferential surface of the can body to form an underlayer (a base coat layer). Note that, in the exemplary embodiment, a white paint is applied to form the underlayer.

On the downstream side of the washer (WS), the conveyance route of the can body branches off, and the can body having passed through the washer (WS) is conveyed to either over varnish (OV) or base coater (BC).

In general, the color of the underlayer formed in the base coater (BC) is white for enhancing the colors in printing to be performed, but other colors may be used. Note that the case of the transparent and colorless paint is the same as the case of the over varnish (OV).

On the downstream side of the base coater (BC), the pin oven (PO) is provided in which the can body is heated to bake the underlayer onto the can body.

[Painting Process]

On the downstream side of the pin oven (PO), an inside spray (INS) and a bake oven (BO) as another example of another paint application process are provided.

In the inside spray (INS), application (spraying) of the paint onto the inner surface of the can body is performed, to thereby carry out the inner surface painting. In the bake oven (BO), the can body is heated to perform baking of the paint (the painting process).

Note that, in the exemplary embodiment, description is given of the case in which the processes of the over varnish (OV), the base coater (BC) and the pin oven (PO) are performed earlier and the processes of the inside spray (INS) and the bake oven (BO) are performed later.

However, not being limited thereto, it may be possible to perform the processes of the inside spray (INS) and the bake oven (BO) earlier and the processes of the over varnish (OV), the base coater (BC) and the pin oven (PO) later.

Incidentally, it is more preferable to perform the processes of the over varnish (OV), the base coater (BC) and the pin oven (PO) earlier and the processes of the inside spray (INS) and the bake oven (BO) later.

Performing the processes of the inside spray (INS) and the bake oven (BO) later causes the inner surface of the can body to be coated with the paint after performing the processes of the over varnish (OV) and the base coater (BC); therefore, the inner surface of the can body can be more hygienic.

Specifically, in the processes of the over varnish (OV), the base coater (BC) and the like, a mandrel (a support member) for supporting a can body is inserted into the inside of the can body and is brought into contact with the inner circumferential surface of the can body.

In the case where the processes of the inside spray (INS) and the bake oven (BO) are performed later, the portion of the inner circumferential surface of the can body with which the mandrel was in contact is coated with a paint, and thereby the inner surface of the can body can be more hygienic.

[Diameter Decreasing Process]

On the downstream side of the bake oven (BO), a necker flanger (SDN) as an example of a diameter decreasing process is provided. In the necker flanger (SDN), the diameter of the opening portion of the can body is decreased and a flange for attaching the can lid is formed.

Note that, hereinafter, necking processing (processing for decreasing the diameter of the opening portion of the can body) and flanging processing (processing for forming the flange for attaching the can lid) are collectively referred to as a "neck process."

Figure 2:
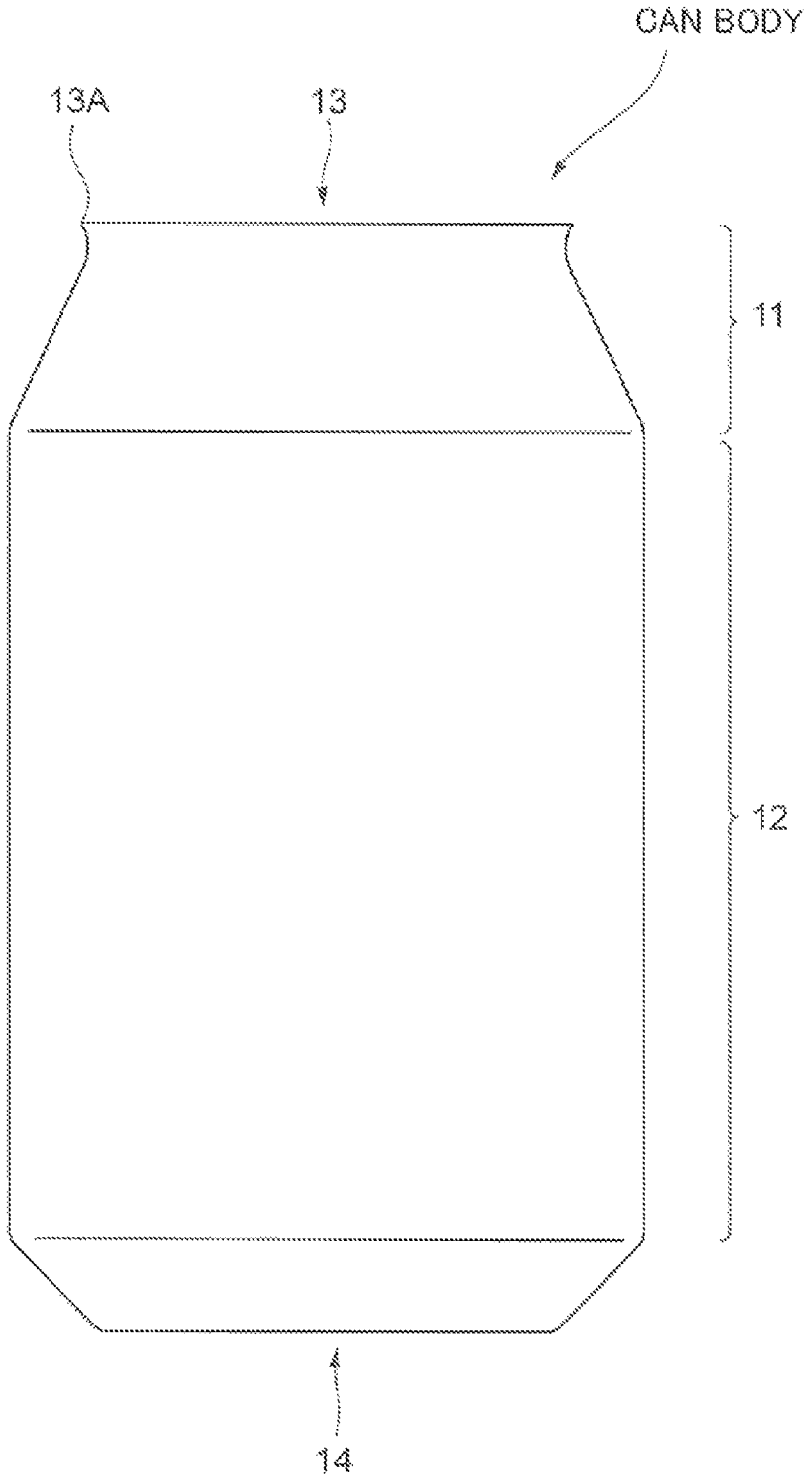
FIG. 2 is a diagram showing a can body after being subjected to a neck process.

FIG. 2 is a diagram showing a can body after being subjected to the neck process; the can body after being subjected to the neck process includes a diameter decreased portion 11 and a barrel portion 12.

The diameter decreased portion 11 is positioned closer to the opening portion 13 of the can body. The diameter decreased portion 11 is formed so that the outer diameter thereof is reduced while approaching the opening portion 13.

The barrel portion 12 is formed into the cylindrical shape and is positioned close to the bottom portion 14 as compared to the diameter decreased portion 11.

The necking processing may be performed by existing methods, and in general, the necking processing is performed by a so-called "die-neck" method that presses a can body into the inside of a die, a so-called "spin flow" method performed by rotating a rotary die, or other methods.

In addition, the flanging processing may also be performed by existing methods; for example, the processing can be achieved by a method described in Japanese Patent Application Laid-Open Publication No. 2016-016419.

Figure 3:
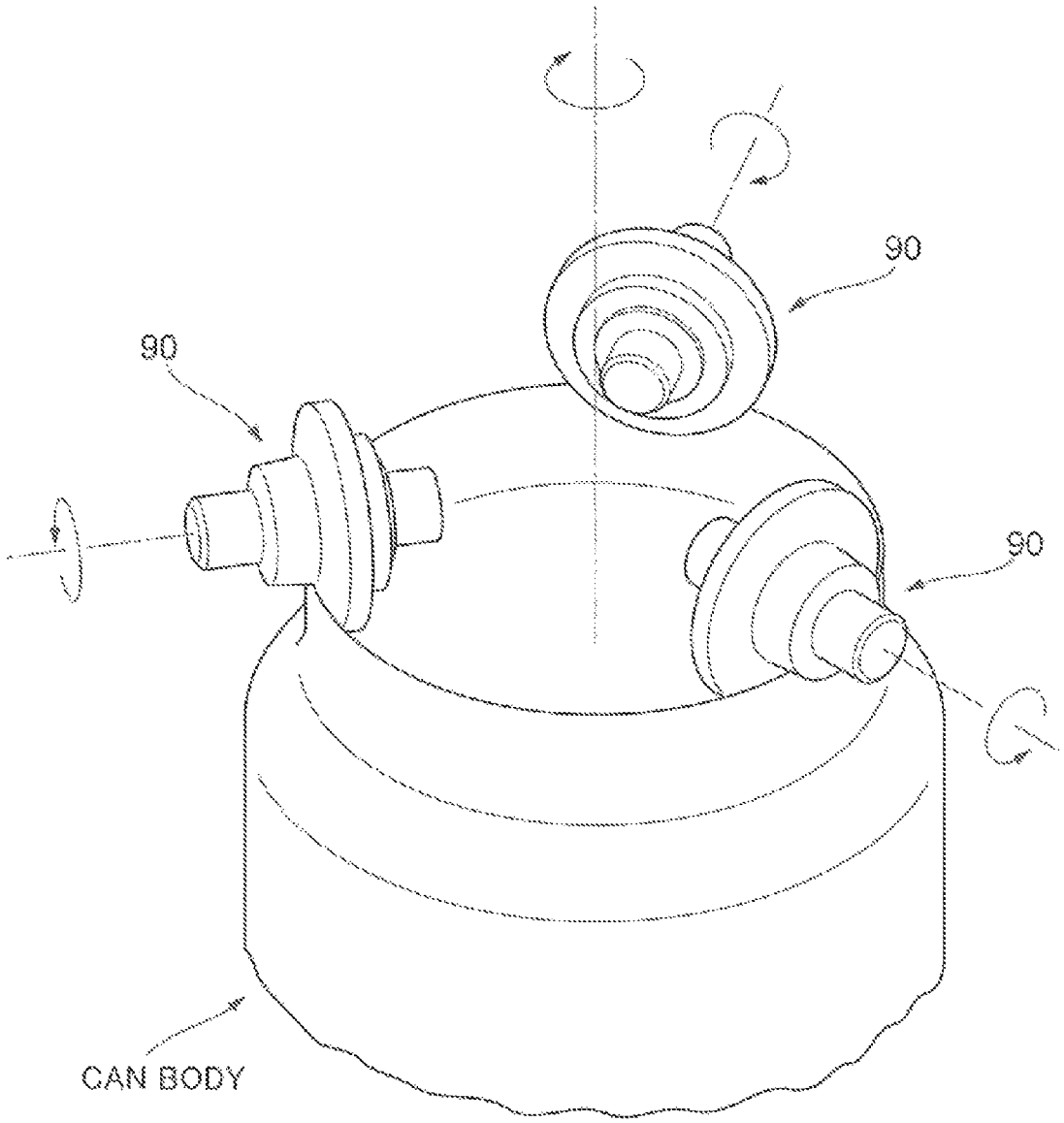
FIG. 3 is a diagram illustrating flanging processing.

In the technique described in Japanese Patent Application Laid-Open Publication No. 2016-016419, as shown in FIG. 3 (the diagram illustrating the flanging processing), the flanging processing is performed by use of rotary dies 90 that are called spinners.

By the way, in the necker flanger (SDN), a press of the die against the can body possibly causes damage to the can body.

In the exemplary embodiment, as shown in FIG. 1, the base coater (BC) and the over varnish (OV) are provided prior to the necker flanger (SDN), and further the inside spray (INS) is provided. Consequently, in the exemplary embodiment, the neck process is performed after protection layers are formed on the outer surface and the inner surface of the can body; therefore, damage is less likely to be caused on the can body.

More specifically, in the exemplary embodiment, a transparent and colorless, or a white paint is applied to a metal can body of a solid color and the paint is further cured; thereby a protection layer is formed on the outer surface of the can body. Further, in the exemplary embodiment, a protection layer is formed on the inner surface of the can body by the inside spray (INS). This causes less damages on the inner surface and the outer surface of the can body.

Incidentally, formation of the protection layer may be performed on only one of the inner surface and the outer surface of the can body.

As shown in FIG. 1, on the downstream side of the necker flanger (SDN), a temporary storage process is provided.

In the temporary storage process, for example, the can bodies are stored in stacks by use of a palletizer (PT). Moreover, additionally, the can bodies may be stored by use of, for example, an accumulator (ACC).

In the temporary storage process, plural can bodies each having the diameter decreased portion 11 (refer to FIG. 2) are arranged in the axial direction and then stacked in the vertical direction.

More specifically, in the temporary storage process, the plural can bodies are arranged in the horizontal direction (the can bodies are arranged two-dimensionally in the horizontal direction), and thereafter, a sheet or the like is placed on these plural can bodies to further arrange plural can bodies two-dimensionally on the sheet. Hereinafter, the process is repeated. This arranges the plural can bodies in the horizontal direction and the vertical direction.

Here, if the can bodies without diameter decreased portions 11 (the can bodies not having been subjected to the diameter decreasing process) are stacked, the can bodies are likely to be deformed; however, in the exemplary embodiment, each of the can bodies has the diameter decreased portion 11, and thereby the can bodies are less likely to be deformed.

Thereafter, in the exemplary embodiment, when predetermined conditions are satisfied, such as a case of receiving a shipping instruction of the can bodies, supply of the can bodies from the temporary storage process is started. To put it another way, the stacks are broken by a depalletizer (DPL) and the can bodies are reintroduced to the can body manufacturing process.

On the downstream side of the depalletizer (DPL), the base coater (BC) and the pin oven (PO) are provided. In the case where the can bodies started to be supplied have been subjected only to the over varnish (OV), a colored (single-colored) underlayer is formed in the base coater (BC) and further, baking of the underlayer is performed in the pin oven (PO).

Note that, in the case where each of the can bodies started to be supplied has the underlayer having already been formed, the processes by the base coater (BC) and the pin oven (PO) are not performed and the can bodies are conveyed along the route indicated by the reference sign 1A. Moreover, even in the case where the can bodies started to be supplied have been subjected only to the over varnish (OV), if the process by the base coater (BC) is not needed, the can bodies are similarly conveyed along the route indicated by the reference sign 1A.

Note that, in the exemplary embodiment, the underlayer is cured by being baked, but this is merely an example; in the case where the underlayer is formed by a paint curable by irradiation with ultraviolet light or the like, the underlayer is cured by irradiation with the ultraviolet light or the like.

[Image Formation Process]

Thereafter, a process by a printer (PR) as an example of the image formation process is started.

Figure 4:
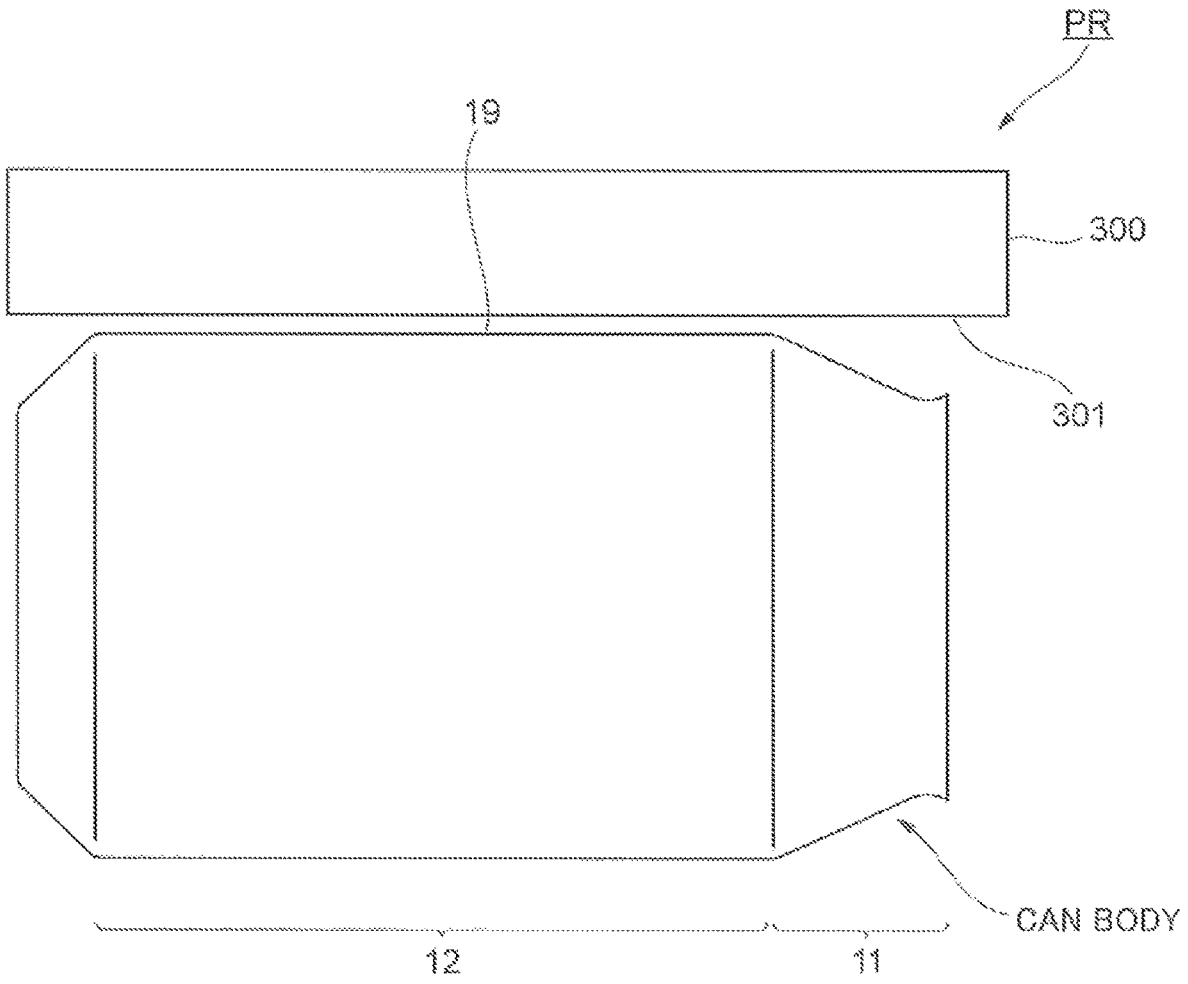
FIG. 4 is a diagram illustrating a process in a printer.

Specifically, in the exemplary embodiment, as shown in FIG. 4 (the diagram illustrating the process in the printer (PR)), the printer (PR) is provided with an inkjet head 300. Then, from the inkjet head 300, ink is ejected toward the can body positioned below. Consequently, image formation onto the outer circumferential surface 19 of the can body is performed. To put it another way, in the exemplary embodiment, a non-contact image forming method is used to perform image formation onto the can body.

Here, in the exemplary embodiment, the can body is provided with the diameter decreased portion 11, and the location of the outer circumferential surface 19 of the can body, where the diameter decreased portion 11 is provided, is to be separated from a lower surface 301 (a surface provided with ink ejection ports) of the inkjet head 300.

In this case, there is a possibility that the quality of image to be formed is deteriorated at the location of the outer circumferential surface 19 of the can body where the diameter decreased portion 11 is provided.

For this reason, in the image formation process in the printer (PR), for example, image formation may be performed only to the barrel portion 12 without performing image formation on the diameter decreased portion 11.

Like this, in the case where image formation is performed only to the barrel portion 12, an image of a single solid color or a colorless underlayer is formed on the diameter decreased portion 11, and an image composed of plural colors is formed on the barrel portion 12.

To additionally describe, on the diameter decreased portion 11, only the single-colored underlayer is formed by the base coater (BC) or only the colorless underlayer is formed by the over varnish (OV), whereas a multi-colored design pattern is formed on the barrel portion 12.

Note that there is no intention to eliminate image formation onto the diameter decreased portion 11; image formation may be performed onto the outer circumferential surface of the diameter decreased portion 11 by use of the inkjet head 300.

The image to be formed on the diameter decreased portion 11 by use of the inkjet head 300 is not particularly limited; for example, a color image using inks of plural colors may be formed, or a single-colored image using an ink of a single color (a solid image) may be formed. In addition, for example, a strip-shaped image along the circumferential direction of the can body may be formed.

Moreover, in the case where an outer shape of the diameter decreased portion 11 is in a stepped shape, such as a four-stepped neck (in the case where the diameter is decreased in a stepwise manner while approaching the opening portion 13), the colors of the image to be formed are varied for the respective steps, and, for example, the strip-shaped images of four colors along the circumferential direction of the can body may be formed onto the diameter decreased portion 11.

Further, in the image formation process in the printer (PR), after image formation by the inkjet head 300, a paint is applied to the outer circumferential surface 19 of the can body to form a protection layer (an overcoat layer).

To put it another way, in the image formation process by the printer (PR), the ink is injected as droplets from a nozzle and causes the ink to adhere to the outer circumferential surface 19 of the can body to form an image on the outer circumferential surface 19 of the can body, and further, the paint is applied onto the image to form the protection layer.

Here, the printer (PR) uses, for example, inks of four colors: cyan (C); magenta (M); yellow (Y); and black (K) as the basic inks, and further, inks of special colors (special-color inks) prepared for each brand are used as necessary.

Moreover, in this case, the inkjet head 300 is prepared for each color, to thereby perform image formation onto the can body by use of the plural inkjet heads 300.

In addition, as the ink to be used, an actinic radiation cure ink is desirable. Here, examples of the actinic radiation cure ink include an ultraviolet (UV) cure ink.

Further, in the printer (PR), a cylindrical mandrel (not shown in FIG. 4), which is an example of a support member, is inserted into the inside of the can body to support thereof from the inside, and thereafter, printing on the can body is performed. Further, at this time, the mandrel is rotated in the circumferential direction, to thereby rotate the can body in the circumferential direction.

Moreover, in the printer (PR), so-called digital printing, which is printing based on image data, is performed.

Here, it is more preferable that the resolution in the printer (PR) is high; however, considering the costs, productivity and so forth, it is preferable to set the resolution at, for example, about 600 dpi.

Moreover, from the standpoint of improving the quality of the image to be formed, it is more preferable to reduce the distance between the can body and the inkjet head 300; however, if the distance is too short, there is a possibility that the can body and the inkjet head 300 interfere with each other. The separation distance between the can body and the inkjet head 300 may be set at, for example, about 1 mm.

Moreover, the larger number of rotations of the can body contributes to the productivity; however, if the number of rotations is excessively large, when the ink arrives at the can body, there is a possibility that the ink spreads in the circumferential direction of the can body, to thereby reduce the resolution. Therefore, it is desirable to rotate the can body at the number of rotations capable of suppressing the spread of the ink in the circumferential direction of the can body, while increasing the number of rotations.

Moreover, in the case where the ultraviolet cure ink is used, it may be possible that, every time the ink of a single color is ejected to the can body, the ultraviolet light is applied to the ink to cure thereof, or it may be possible that, after the inks of plural colors are ejected, the ultraviolet light is applied to the inks to collectively cure thereof.

Note that, in the printer (PR), it is preferable to use a mandrel having a part thereof the diameter of which is increased when the mandrel is inserted into a can body. To put it another way, it is preferable to use a mandrel, the diameter of part of which is increased after being inserted into the can body, the part being brought into contact with an inner circumferential surface of the can body. To additionally describe, it is preferable to use a mandrel including a portion approaching the inner circumferential surface of the can body from a location separated from the inner circumferential surface to contact thereof.

In the exemplary embodiment, the diameter of the opening portion 13 (refer to FIG. 2) of the can body is decreased, and thereby, in the can body at the time of the image formation, the diameter of the opening portion 13 is smaller than that of the barrel portion 12 of the can body.

Therefore, mere insertion of the cylindrical mandrel into the can body generates a gap between the can body and the mandrel, to thereby cause instable support of the can body. Use of the mandrel capable of increasing the diameter to bring a part of the mandrel into contact with the inner circumferential surface of the can body achieves more stable support of the can body.

Figure 5:
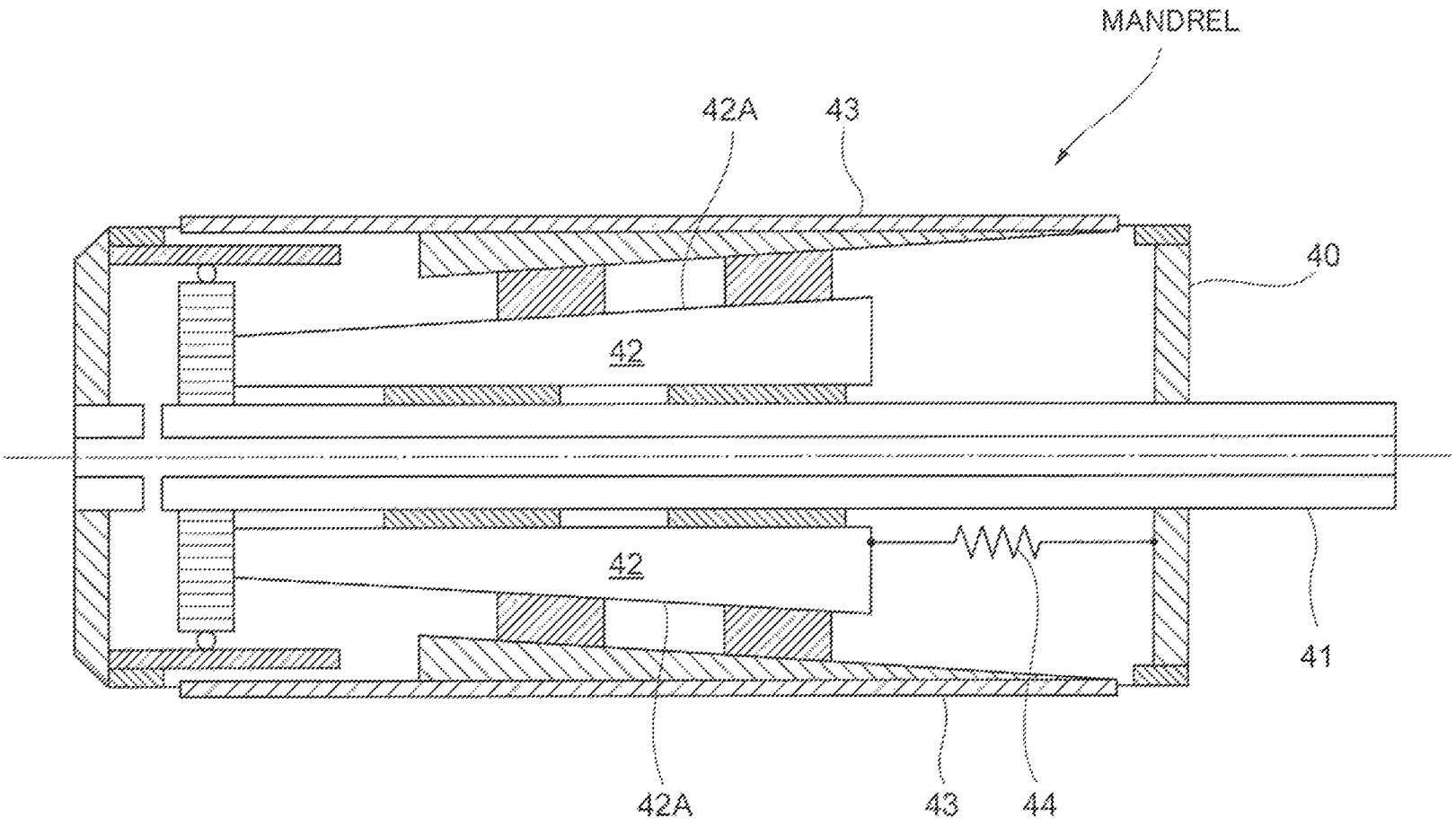
FIG. 5 is a diagram showing an example of a mandrel that increases a diameter thereof.

FIG. 5 is a diagram showing an example of the mandrel capable of increasing the diameter thereof; in the mandrel, when the mandrel is inserted into a can body (not shown in FIG. 5), a contact member 40 having a circular disk shape is brought into contact with an opening edge 13A (refer to FIG. 2) of the can body. Thereafter, (a shaft 41 of) the mandrel is further moved toward the bottom portion 14 (refer to FIG. 2) of the can body.

Consequently, a tapered surface 42A of an attachment member 42 attached to the shaft 41 presses the moving member 43 toward the inner circumferential surface of the can body; thereby the moving member 43 is pressed against the inner circumferential surface of the can body.

Here, the mandrel is reversible, and therefore, when the mandrel is moved in a direction in which the mandrel is taken out of the can body, the attachment member 42 is moved by a spring member 44 to approach the contact member 40. Consequently, pressing of the moving member 43 by the attachment member 42 is canceled, and thereby the moving member 43 can move in a direction to be separated from the inner circumferential surface of the can body.

Figure 6:
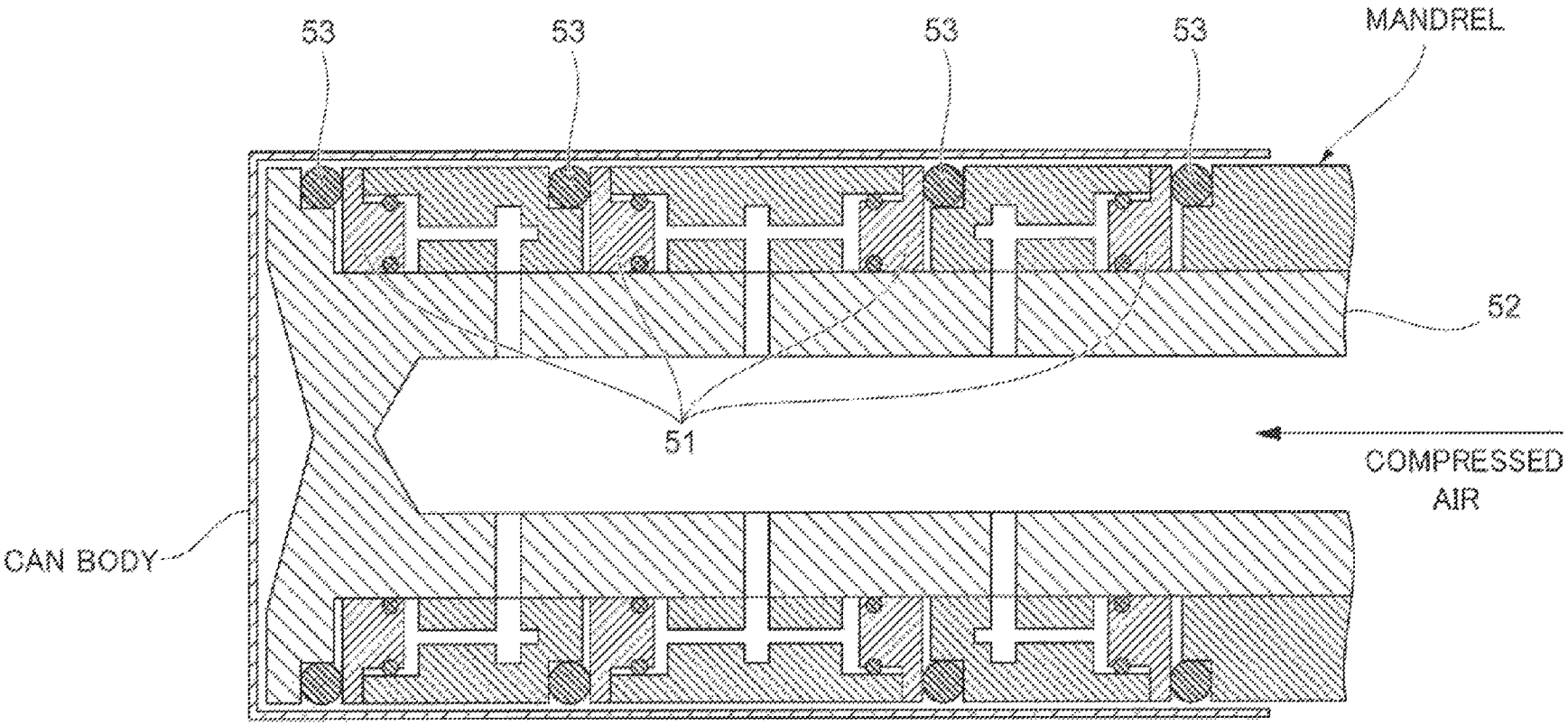
FIG. 6 is a diagram showing another example of the mandrel that increases a diameter thereof.

Moreover, FIG. 6 is a diagram showing another example of the mandrel capable of increasing the diameter thereof; in the mandrel, moving bodies 51 are moved in the axial direction of a mandrel main body 52 by use of compressed air, to thereby compress annular-shaped elastic members 53 attached to an outer circumferential portion of the mandrel main body 52. Consequently, the elastic members 53 project outwardly in the radial direction of the mandrel to be pressed against the inner circumferential surface of the can body.

When the mandrel is detached, for example, the air inside the mandrel main body 52 is sucked. This moves the moving bodies 51 in the reverse direction, to thereby restore the elastic members 53. Restoration of the elastic members 53 separates the elastic members 53 from the inner circumferential surface of the can body.

Figure 7:
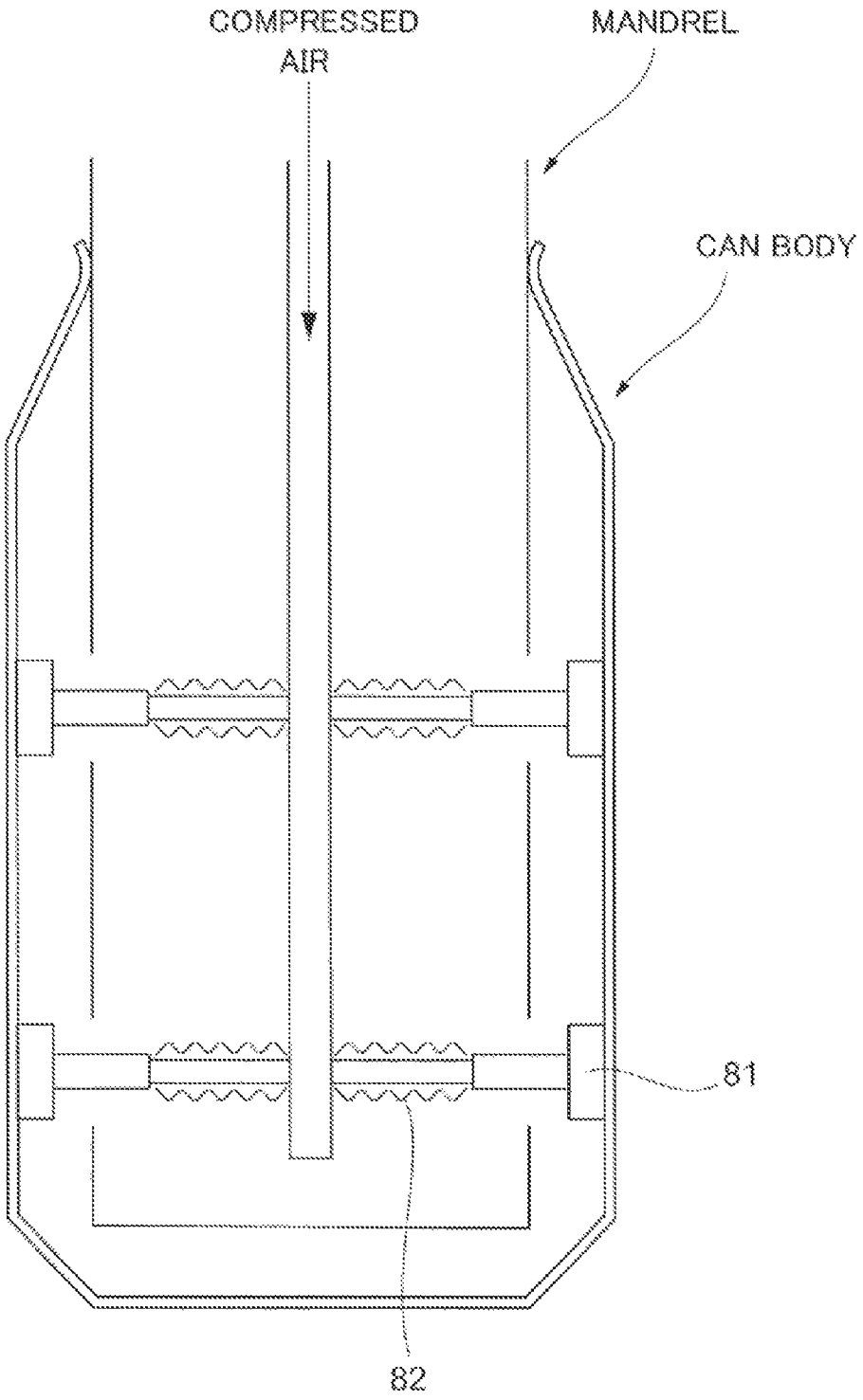
FIG. 7 is a diagram showing another example of the mandrel that increases a diameter thereof.

FIG. 7 is a diagram showing still another example of the mandrel capable of increasing the diameter thereof.

The mandrel is provided with reciprocating members 81 reciprocating with respect to the inner circumferential surface of a can body. In the mandrel, compressed air is supplied to pressurize the reciprocating members 81, and thereby the reciprocating members 81 are brought into contact with the inner circumferential surface of the can body. Note that the mandrel is also reversible; therefore, when supply of the compressed air is stopped, the reciprocating members 81 are moved in a direction to be separated from the inner circumferential surface of the can body by coil springs 82.

With reference to FIG. 1, the manufacturing process will be further described.

On the downstream side of the printer (PR), provided are a bottom coater (BTC), the pin oven (PO), a defective can tester (DCT), a light tester (LT) and the palletizer (PT).

In the bottom coater (BTC), painting is performed on a grounding portion of a bottom portion 14 of a can body. In the pin oven (PO), the can body is heated to bake the image on the outer circumferential surface of the can body and the painting on the bottom portion 14.

Here, in the exemplary embodiment, two pairs of the bottom coater (BTC) and the pin oven (PO) are provided to correspond to respective two types of printers (PR) (two types of printers (PR) represented by reference signs 1B and 1C). However, the present invention is not limited thereto; only one pair of the bottom coater (BTC) and the pin oven (PO) are provided to share facilities.

In the defective can tester (DCT), the outer appearance of the can body and the state of printing are inspected, and if there is any defective item, the item is removed.

In the light tester (LT), whether or not there is any puncture in the can body is inspected, and if there is any defective item, the item is removed.

In the palletizer (PT), the can bodies having passed the tests are placed (stacked) on a pallet.

Thereafter, the can bodies are shipped to, for example, a beverage can manufacturing factory (the process of packaging beverage), and beverage is packaged into the can bodies and lids are attached to the can bodies in the beverage can manufacturing factory. Consequently, beverage cans are completed.

Note that the manufacturing process shown in FIG. 1 is merely an example, and the processes may be replaced within a scope that does not deviate from the gist of the present invention.

In addition, in the manufacturing process of the can bodies, conveyors are mainly used for conveying the can bodies; however, the can bodies may be conveyed by use of a conveyance mechanism other than the conveyors. Moreover, in the case where the conveyors are used for conveying the can bodies, for example, mass conveyors and single conveyors are used. Here, in FIG. 1, the conveyance route shown by a single line indicates the conveyance route in which the can bodies are conveyed by a single conveyor, whereas the conveyance route shown by double lines indicates the conveyance route in which the can bodies are conveyed by a mass conveyor.

Moreover, each process may be provided with a single facility or plural facilities.

In the case where the plural facilities are provided, the conveyance route of the can bodies is branched to supply the can bodies to each of the plural facilities. In addition, in this case, the conveyance routes are merged at the downstream side of each facility.

Second Exemplary Embodiment

Figure 8:
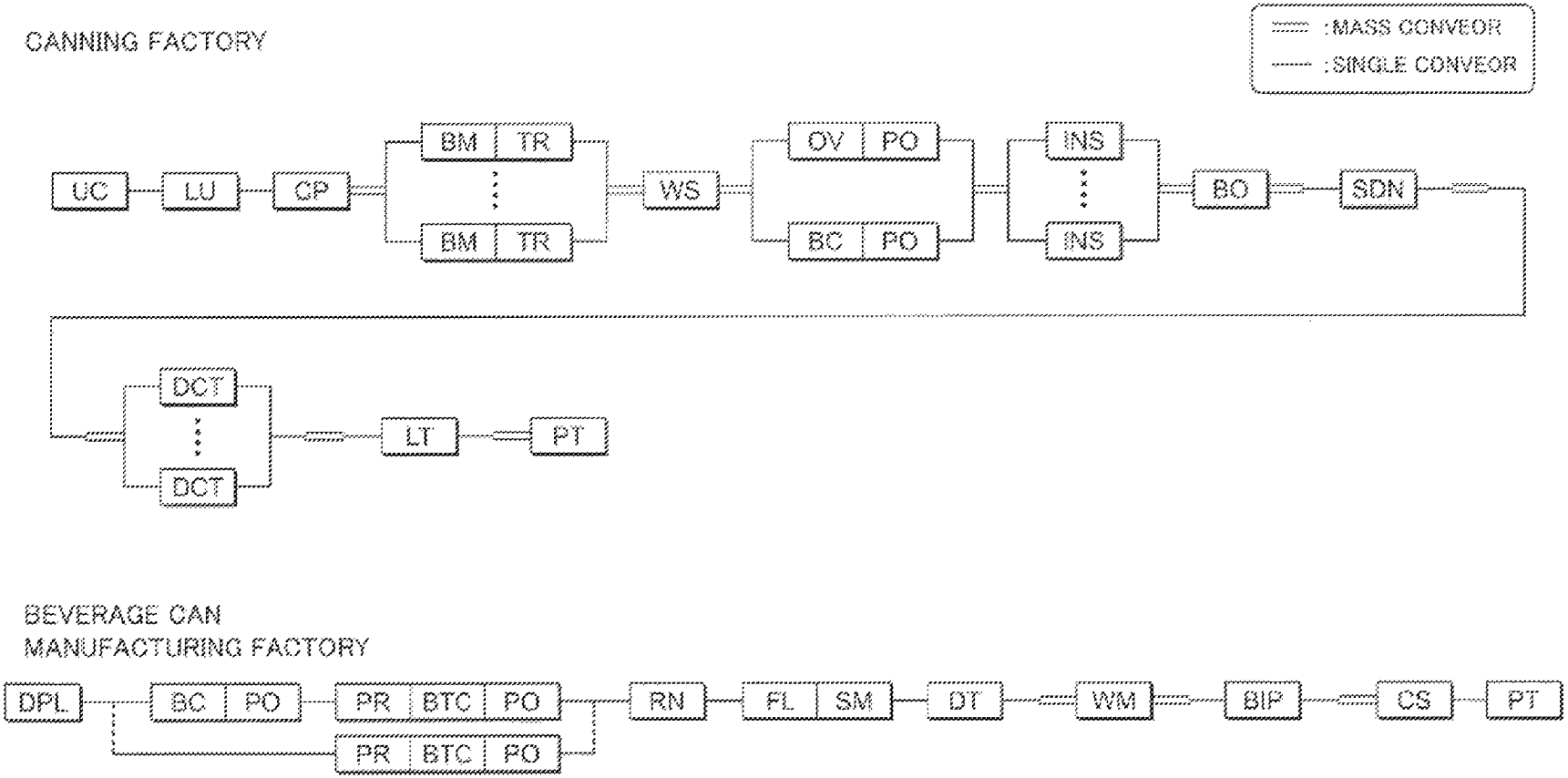
FIG. 8 is a diagram showing another exemplary embodiment of the manufacturing process of a beverage can.

FIG. 8 is a diagram showing another exemplary embodiment of the manufacturing process of the beverage cans. Note that, with regard to the processes having functions similar to those of the exemplary embodiment shown in FIG. 1, same reference signs are given to omit detailed descriptions thereof.

In the exemplary embodiment shown in FIG. 1, the manufacturing process of the cans for beverage (the manufacturing process in a canning factory) was described. In FIG. 8, not only the manufacturing process of the cans for beverage (the manufacturing process in a canning factory), but also a contents packaging process that fills the cans for beverage with beverage (a manufacturing process in a beverage can manufacturing factory) is illustrated.

In FIG. 8, on the upper side, the manufacturing process in the canning factory is shown.

Up to the necker flanger (SDN), the manufacturing process in the canning factory includes the same manufacturing process as the exemplary embodiment shown in FIG. 1. Specifically, each of the processes starting from the uncoiler (UC) to the necker flanger (SDN) are provided.

On the other hand, the manufacturing process (the manufacturing process in the canning factory) in the exemplary embodiment is not provided with the printer (PR), but is provided with the defective can tester (DCT), the light tester (LT) and the palletizer (PT).

In the manufacturing process (the manufacturing process in the canning factory) in the exemplary embodiment, after the neck process is performed, inspections of the can bodies are performed without performing the image formation process. Specifically, inspections are performed on the outer appearance of the can body, the state of printing, and whether or not there is any puncture in the can body.

Thereafter, in the palletizer (PT), the can bodies are stacked to generate pallets each containing plural can bodies. Then, the pallets are shipped to the beverage can manufacturing factory.

In the exemplary embodiment, image formation onto the can bodies is not performed in the canning factory, and the can bodies on which image formation has not been performed are manufactured. Specifically, can bodies having been subjected to the inner surface painting, the outer surface painting and the neck process but having not been subjected to image formation are manufactured. The can bodies that have not been subjected to image formation are shipped to the beverage can manufacturing factory.

Note that, in the exemplary embodiment, the case where stacking is performed by the palletizer (PT) and thereafter the shipment is performed is shown as an example; however, any form of shipment may be accepted.

Moreover, the defective can tester (DCT) and the light tester (LT) may be omitted if not needed.

In the beverage can manufacturing factory, first, the depalletizer (DPL) is performed to start releasing of the can bodies. On the downstream side of the depalletizer (DPL), the base coater (BC) and the pin oven (PO) are provided, and similar to the above, for the can bodies having been subjected only to the over varnish (OV), formation and baking of the underlayer is performed.

On the other hand, for the can body including the underlayer having already been formed thereon, or for the can body that has been subjected only to the over varnish (OV) but does not need the underlayer, the base coater (BC) and the pin oven (PO) are unnecessary; thereby formation and baking of the underlayer is omitted.

Thereafter, similar to the above, the image formation process using the printer (PR) is performed. Specifically, similar to the above, the ink is ejected from the inkjet head 300 provided to the printer (PR) toward the can body, to thereby form an image on the outer circumferential surface of the can body.

On the downstream side of the printer (PR), the bottom coater (BTC) and the pin oven (PO) are provided to perform painting on the grounding portion of the bottom portion 14 of the can body, and further perform heating of the can body. This bakes the image on the outer circumferential surface of the can body and the painting on the bottom portion 14 of a can part onto the can body.

Thereafter, in a rinser (RN), the can body is washed in water. Note that the printer (PR) may be provided after the rinser (RN).

[Beverage Packaging Process]

Next, the can body is filled with beverage in a filler (FL) as an example of the beverage packaging process, and then a can lid is attached to the can body in a seamer (SM). Note that the process in the filler (FL) may be performed by existing techniques; for example, the processing can be achieved by a process described in Japanese Patent Application Laid-Open Publication No. 2009-026009.

Thereafter, by use of various kinds of inspection machines (DT), inspection of the filling amount, inspection of foreign materials, and so on are performed. Note that the inspections may be performed before box packing in a caser (CS) to be described later. In addition, these inspections may be performed as many times as needed to improve the quality.

Thereafter, temperature of contents is returned to ordinary temperature in a warmer (WM). Here, in high-temperature packaging referred to as so-called hot pack, which is packaging of tea-based beverage, coffee beverage and the like, the warmer (WM) is unnecessary.

Note that the contents requiring to be sterilized are subjected to sterilization before the box packing in the caser (CS) to be described later. Here, examples of sterilization methods include low-temperature sterilization (pasteurization) and high temperature and pressure vapor sterilization (retort).

Thereafter, required information, such as the manufacturing date, the lot number and the best-before date, is printed on the bottom portion 14 of the can body (the beverage can) by use of the inkjet head in a can bottom printer (BIP). In addition, the printing state is inspected by a not-shown inspection machine.

Here, to perform printing by the can bottom printer (BIP), it is preferable to perform printing after water droplets on the bottom portion 14 of the can body are blown off by high-pressure air. After the can body has passed through the warmer (WM), the water droplets are attached to the bottom portion 14 of the can body; therefore, printing performed after the water droplets are blown off by high-pressure air improves the printing quality.

Note that timing of the printing by the can bottom printer (BIP) is not limited to the time after the process of the warmer (WM); the printing may be performed any of the timings before the box packing in the caser (CS), and, for example, the printing may be performed immediately after the process of the depalletizer (DPL).

After that, the box packing of the can bodies (the beverage cans) is performed in the caser (CS). Here, in the box packing, 24 cans are packed in one box in general. In the case where the box packing is performed by six-pack, the can bodies of four packs are contained in one box.

Thereafter, in the palletizer (PT), the boxes containing the can bodies are stacked on the pallets.

In the exemplary embodiment, image formation onto the can bodies is performed in the beverage can manufacturing factory; therefore, printed can bodies can be prepared according to the amount of prepared contents (total amount).

In this case, the contents and the can bodies can be used (consumed) just enough, to thereby make it possible to suppress occurrence of wasted contents and wasted can bodies.

Figure 9:
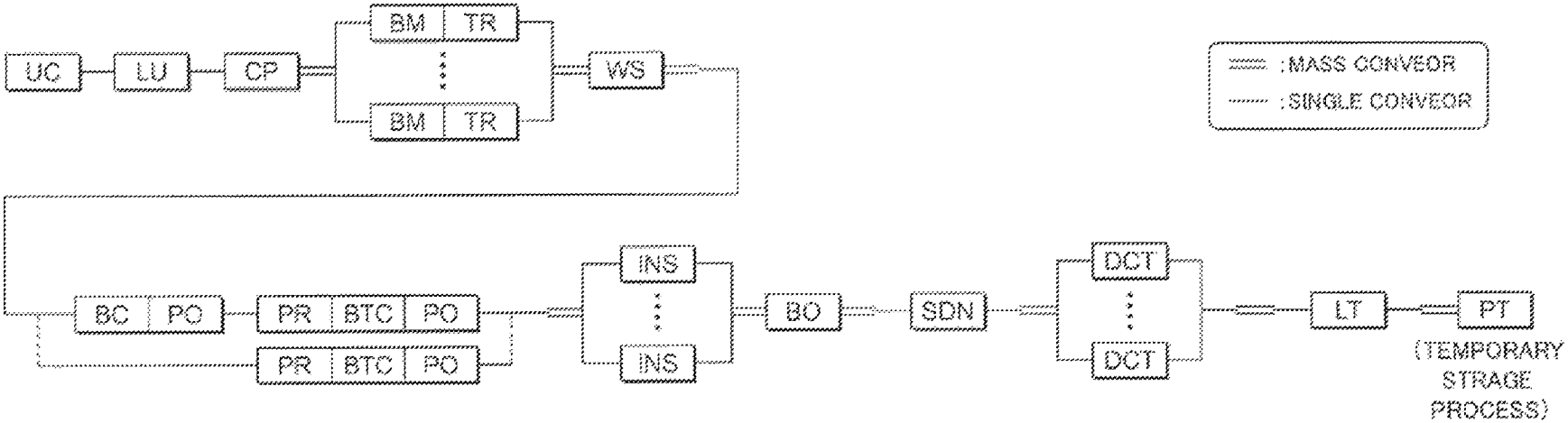
FIG. 9 is a diagram showing a conventional manufacturing process of a can body.

FIG. 9 is a diagram showing a conventional manufacturing process of can bodies. Note that, with regard to the processes having functions similar to those of the exemplary embodiments described above, same reference signs are given to omit detailed descriptions thereof.

In the conventional manufacturing process, the printing method in the printer (PR) is the plate printing method. Further, in the conventional manufacturing process, the printer (PR) is positioned on the upstream side of the necker flanger (SDN) in the can body conveyance direction.

In addition, in the conventional manufacturing process, the palletizer (PT, in the temporary storage process) is provided on the downstream side of the printer (PR) and the necker flanger (SDN). For this reason, when the can bodies are stored, images have already been formed or the neck process has already been performed on the can bodies.

Consequently, in the conventional manufacturing process, to ship the can bodies, the can bodies on which the images have been formed or the neck process has been performed are to be shipped.

Here, in the conventional manufacturing process, the printing method is the plate printing method. The plate printing method requires more time for preparation of printing, and therefore, it is difficult to deal with a rush order. Specifically, in the plate printing method, plate making is performed after design drawing is acquired, further, a printing plate is disposed on a printing machine, and still further, preparation such as color matching and the like is required; therefore, much time is necessary before the printing is started.

To reduce time, it is preferable to manufacture the cans before receiving an order and store the printed can bodies in stock in advance.

Incidentally, in this case, it is necessary to secure a place for stock; therefore, there is a problem of taking storage costs and the like. In addition, recently, the time to change the design or to discontinue a brand has been reduced; therefore, if the cans are manufactured in advance and stored in stock, wasted can bodies are likely to be generated. Further, there are some cases in which part of design is changed, and in this case, the wasted can bodies to be discarded are also generated.

In this manner, in the conventional manufacturing process, it was necessary to secure the stock, and further, discard of the stock was likely to occur.

In contrast thereto, in the exemplary embodiment, the can bodies are kept in stock without being printed. In this case, even though the design is changed, it becomes possible to perform printing with changed design, and accordingly, wasted can bodies are less likely to be generated.

Further, in the exemplary embodiment, since digital printing using the inkjet head 300 is performed, it is unnecessary to prepare the printing plate and the like, and requires less time to start printing.

In addition, in the case where the inkjet method is used, it is possible to perform high-saturation printing and non-contact printing.

Here, even in the case where the printing plate is used, by performing printing onto the can bodies after receiving an order, the can bodies having been subjected to the neck process, it is possible to suppress occurrence of the wasted stock as described above.

However, in the plate printing, ink is transferred onto the can body, and therefore, large pressure is applied between the can body and a blanket (a contact member brought into contact with the can body to transfer ink onto the can body) of a printing machine when printing is performed.

In this case, the can body is deformed to be dented inward, and it becomes substantially difficult to print on the can body.

More specifically, in the can body subjected to the neck process has, as described above, the diameter of the barrel portion 12 is larger than the diameter of the opening portion 13 (refer to FIG. 2); therefore, mere insertion of an ordinary mandrel into the can body generates a gap between the can body and the mandrel. If the blanket of the printing machine is pressed against the can body in this state, the can body is dented inward.

In contrast thereto, in the inkjet method adopted in the exemplary embodiment, the inkjet method 300 and the can body are not in contact with each other, and therefore, no pressure is applied to the can body. In this case, even though a gap exists between the mandrel and the can body, it becomes possible to perform printing onto the can body.

Note that, more preferably, as shown in FIGS. 5 to 7, it is desirable to bring the mandrel into contact with the inner circumferential surface of the barrel portion 12 of the can body by use of the mandrel capable of increasing the diameter. This supports the can body with more stability.

Here, increase of the diameter of the mandrel is not essential; for example, if the bottom portion 14 (refer to FIG. 2) of the can body is sucked by the tip end portion of the mandrel to support the can body, movement of the can body can be suppressed, and in this case, it becomes unnecessary to expand the diameter of the mandrel.

Figure 10:
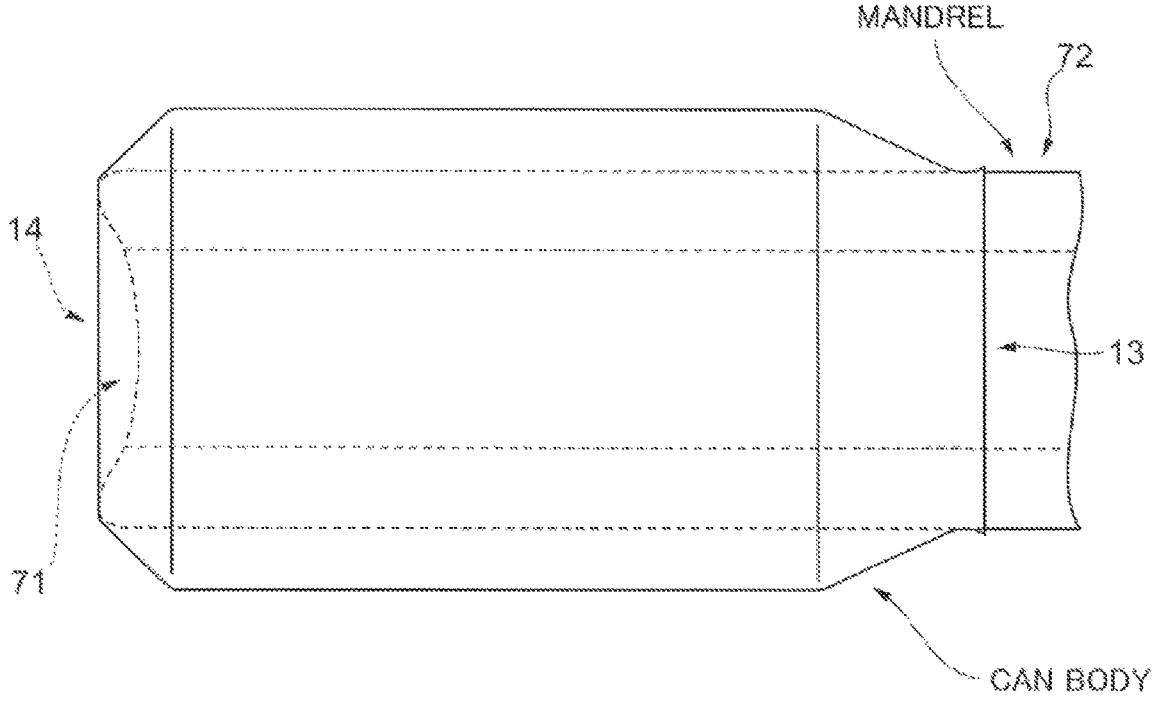
FIG. 10 is a diagram showing another example of support of a can body by a mandrel.

FIG. 10 (the diagram showing another example of support of a can body by a mandrel) exemplifies the case in which the bottom portion 14 of the can body is sucked by a mandrel. The mandrel is formed cylindrically and is provided with an opening 71 at a leading end portion in the insertion direction when the mandrel is inserted into the can body. Further, in the configuration example, air inside the mandrel is sucked from a base 72 side of the mandrel by a not-shown suction mechanism.

In the configuration example, the mandrel is inserted from the opening portion 13 of the can body and the bottom portion 14 positioned at an opposite side of the opening portion 13 is sucked by the mandrel, and thereby the bottom portion 14 is supported by the mandrel. Further, in the example, a part of the opening portion 13 of the can body is also supported by the mandrel. Consequently, the can body is supported by the mandrel with more stability.

Further, in the configuration example, the bottom portion 14 has a convex shape toward the inside of the can body (projects in a dome shape toward the inside of the can body), and the convex portion enters the inside of the mandrel. This makes the shaft center of the mandrel and the central position of the bottom portion 14 of the can body (the central position in the radial direction) coincide with each other.

Moreover, the can body may be supported by use of another mechanism.

Figure 11:
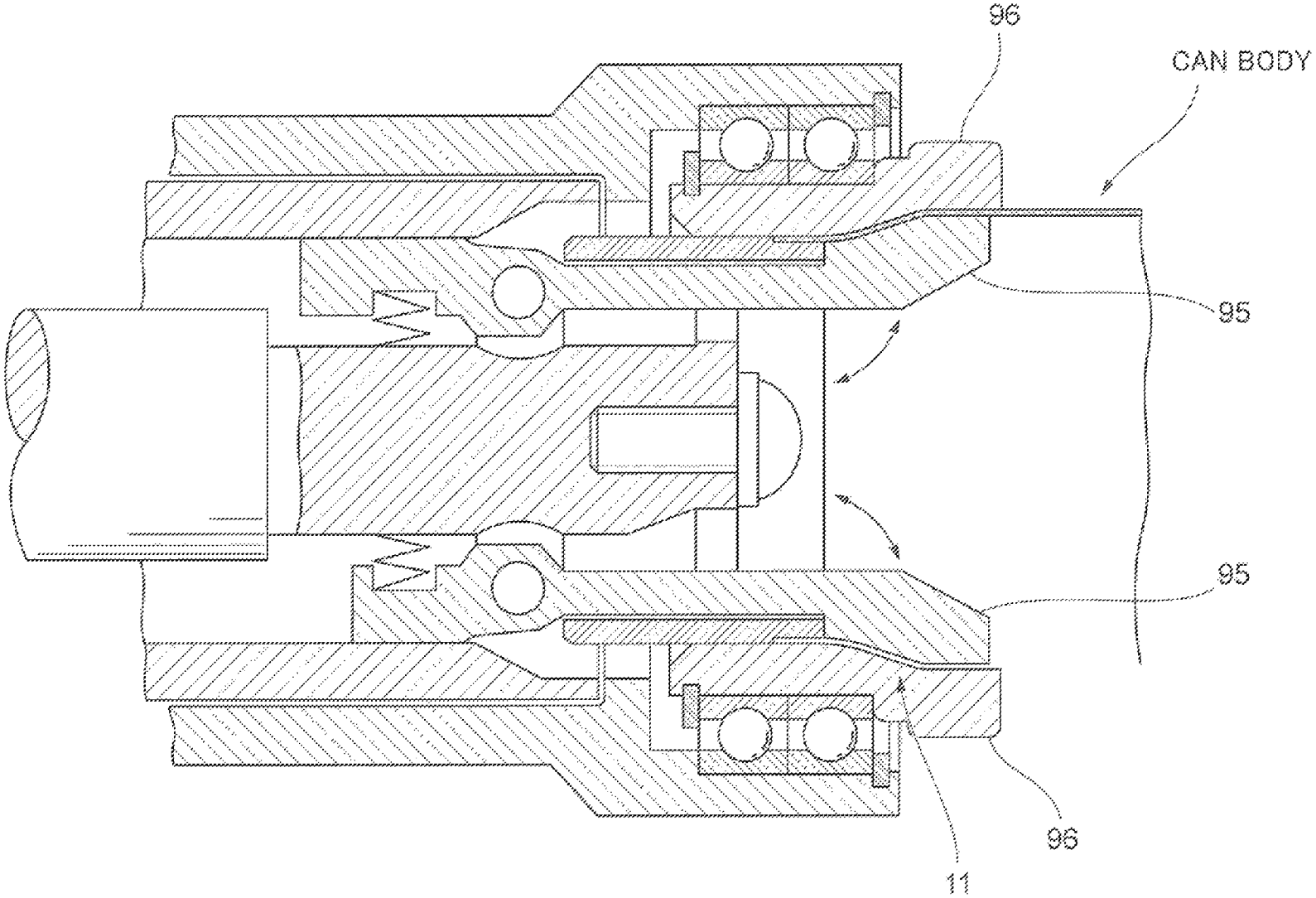
FIG. 11 is a diagram showing another configuration example of a mechanism for supporting a can body.

Specifically, for example, as shown in FIG. 11 (the diagram showing another configuration example of a mechanism supporting the can body), the can body may be supported by holding the diameter decreased portion 11 of the can body from both inside and outside. More specifically, in the configuration example, a part of the diameter decreased portion 11 of the can body is held by both inside member 95 disposed inside the can body and outside member 96 disposed outside the can body, the inside member 95 reciprocating with respect to the inner circumferential surface of the can body, and thereby the can body is held.

Figure 12:
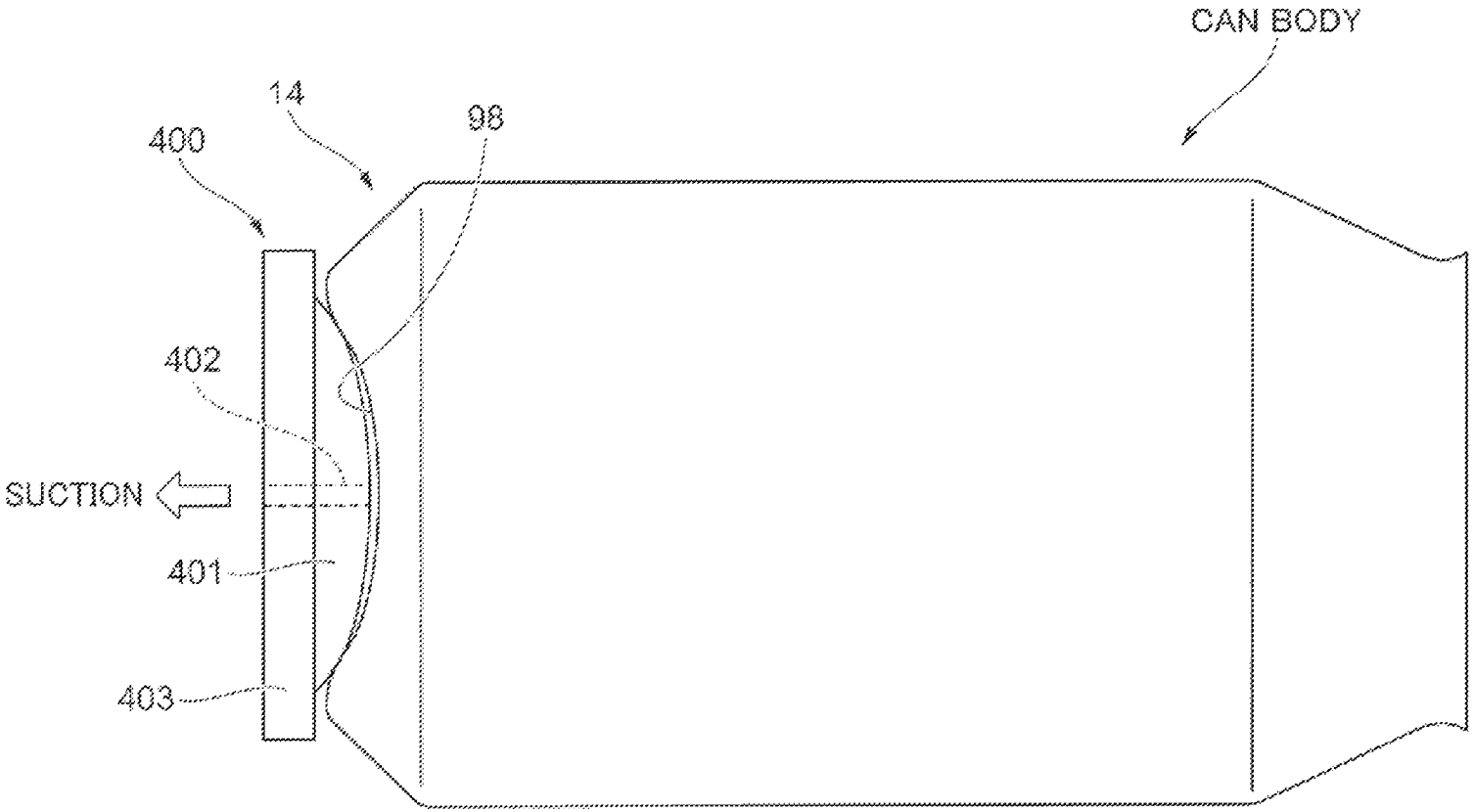
FIG. 12 is a diagram showing another configuration example of a mechanism for supporting a can body.

Moreover, as shown in FIG. 12 (the diagram showing another configuration example of a mechanism supporting the can body), the can body may be supported by sucking the bottom portion 14 of the can body from the outside of the can body by a pad member 400.

The pad member 400 includes a convex portion 401 that fits into a concave portion 98 (the concave portion 98 concaving toward the inside of the can body) provided to the bottom portion 14 of the can body. Further, the pad member 400 sucks the can body through a hole 402 positioned at the center in the radial direction, to thereby hold the can body. Still further, the pad member 400 includes a flat plate portion 403 that serves as a pedestal of the convex portion 401.

Note that an annular-shaped groove corresponding to the shape of the grounding portion of the can body provided to locations positioned around the convex portion 401 on the surface of the flat plate portion 403 disposed on the can body side improves a capability of holding the can body.

REFERENCE SIGNS LIST

12: Barrel portion
13: Opening portion
14: Bottom portion
300: Inkjet head
BC: Base coater
BM: Body maker
FL: Filler
INS: Inside spray
OV: Over varnish
PR: Printer
SDN: Necker flanger

The invention claimed is:

1. A method for manufacturing a can for beverage, comprising:

a molding process of molding a cup-shaped material to obtain a cylindrical can body having an open portion at one end and a closed bottom portion at the other end, a diameter decreasing process decreasing a diameter of the open portion of the cylindrical can body; and an image formation process forming an image onto an outer surface of the can body having been subjected to diameter decreasing by the diameter decreasing process.

2. The method for manufacturing a can for beverage according to claim 1, further comprising:

a paint application process applying a paint on at least one of an outer surface and an inner surface of the can body before being subjected to the diameter decreasing by the diameter decreasing process.

3. The method for manufacturing a can for beverage according to claim 1, wherein, in the image formation process, image formation is performed on the can body by use of an image formation method without contacting a can body, the can body having been subjected to the diameter decreasing.

4. The method for manufacturing a can for beverage according to claim 3, wherein, in the image formation process, image formation is performed on the can body by use of an inkjet method, the can body having been subjected to the diameter decreasing.

5. The method for manufacturing a can for beverage according to claim 1, wherein, in the image formation process, the can body is supported by a support member inserted into the can body having been subjected to the diameter decreasing to support the can body from inside thereof, the support member including a portion approaching an inner circumferential surface of the can body to contact the inner circumferential surface.

6. The method for manufacturing a can for beverage according to claim 1, wherein, in the image formation process, the can body having been subjected to the diameter decreasing is supported by a support member supporting the can body from inside thereof, the support member having a function of sucking a bottom portion of the can body positioned at an opposite side of the open portion.

7. The method for manufacturing a can for beverage according to claim 1, further comprising:

a paint application process applying a paint on an inner surface of the can body before being subjected to diameter decreasing by the diameter decreasing process.

8. The method for manufacturing a can for beverage according to claim 1, further comprising:

a paint application process applying a colored paint to an outer surface of the can body.

9. The method for manufacturing a can for beverage according to claim 1, further comprising:

filling the can body with beverage after the can body has been subjected to the diameter decreasing process.

10. The method for manufacturing a beverage can according to claim 9, wherein, in the image formation process, the image is formed on a can barrel portion of the outer surface of the can body having been subjected to the diameter decreasing process, the can barrel portion being a portion of the can body excluding a diameter decreased portion.

11. The method for manufacturing a beverage can according to claim 9, wherein, in the image formation process, image formation is performed on the outer surface of the can body by use of an inkjet method, the can body having been subjected to the diameter decreasing process.

* * * * *